US007329060B2

(12) United States Patent
Jung

(10) Patent No.: US 7,329,060 B2
(45) Date of Patent: Feb. 12, 2008

(54) PRINTING MEDIUM AND PRINTING METHOD FOR PHOTO PRINTER

(75) Inventor: Jong-sung Jung, Suwon-si (KR)

(73) Assignee: Samsung Electronics Co., Ltd, Suwon-Si (KR)

( * ) Notice: Subject to any disclaimer, the term of this patent is extended or adjusted under 35 U.S.C. 154(b) by 384 days.

(21) Appl. No.: 11/025,896

(22) Filed: Jan. 3, 2005

(65) Prior Publication Data

US 2005/0179718 A1 Aug. 18, 2005

(30) Foreign Application Priority Data

Feb. 13, 2004 (KR) ..... 10-2004-0009632

(51) Int. Cl.
*B41J 29/32* (2006.01)
*B42D 15/02* (2006.01)
*B42D 15/00* (2006.01)

(52) U.S. Cl. ..... 400/578; 400/624; 428/43; 428/131; 428/136; 428/32.1

(58) Field of Classification Search ..... None
See application file for complete search history.

(56) References Cited

U.S. PATENT DOCUMENTS

| | | | | |
|---|---|---|---|---|
| 5,466,075 | A | 11/1995 | Kouzai et al. | 400/240.3 |
| 5,786,841 | A | 7/1998 | Bobb et al. | 347/217 |
| 6,164,851 | A | 12/2000 | Sakamoto et al. | 400/207 |
| 6,173,649 | B1 * | 1/2001 | Onishi | 101/483 |
| 6,450,634 | B2 * | 9/2002 | Elgee et al. | 347/106 |
| 6,869,907 | B2 * | 3/2005 | Suzuki | 503/204 |
| 7,033,095 | B2 * | 4/2006 | Shiraiwa | 400/636 |
| 2003/0125206 | A1 | 7/2003 | Bhatt et al. | 503/201 |
| 2004/0114023 | A1 * | 6/2004 | Jacobsen et al. | 347/106 |

FOREIGN PATENT DOCUMENTS

| | | | |
|---|---|---|---|
| CN | 1202425 A | | 12/1998 |
| JP | 63120648 A | * | 5/1988 |
| JP | 64-067368 | | 3/1989 |
| JP | 01-208159 | | 8/1989 |
| JP | 02084368 A | * | 3/1990 |
| JP | 03-009869 | | 1/1991 |
| JP | 4-58369 U | * | 5/1992 |
| JP | 2000343783 A | * | 12/2000 |
| JP | 2002-166607 | | 6/2002 |
| KR | 2001-0072329 | | 7/2001 |

* cited by examiner

*Primary Examiner*—Daniel J. Colilla
(74) *Attorney, Agent, or Firm*—Roylance, Abrams, Berdo & Goodman, LLP

(57) ABSTRACT

A printing medium and a printing method thereof, for a photo printer using the printing medium, wherein the printing medium includes a printing region, and a first tab region and a second tab region extending from both tabs of the printing region in a lengthwise direction and having different lengths from each other, and having a direction display unit formed in a penetrated manner in any one of the first tab region and the second tab region and displaying an inserting direction. The printing medium can also include an ID display unit including a plurality of slits formed in any one of the first tab region and the second tab region in order to display information regarding the printing medium.

15 Claims, 5 Drawing Sheets

PRINTING MEDIUM AND PRINTING METHOD FOR PHOTO PRINTER

BACKGROUND OF THE INVENTION

This application claims the benefit under 35 U.S.C § 119(a) of Korean Patent Application No. 10-2004-0009632, filed in the Korean Intellectual Property Office on Feb. 13, 2004, the entire contents of which are incorporated herein by reference.

1. Field of the Invention

The present invention relates to a printing medium and a printing method for a printer. More particularly, the present invention relates to a printing medium and a printing method for a photo printer.

2. Description of the Related Art

Photo printers that print images taken by digital cameras use various printing technologies such as inkjet, dye sublimation thermal transfer, and direct thermal transfer. Such a photo printer comprises a printing unit that prints an image, and a transfer roller that transfers a printing medium. The printing unit is an inkjet head in the case of an inkjet printer, and a thermal printing head (TPH) in the case of a dye sublimation thermal transfer printer or a direct thermal transfer printer.

Borderless printing is further needed to print these photo images. For this, as shown in FIG. 1, a printing medium 10 used for a photo printer comprises a printing region 1, a top tab region 2, and a bottom tab region 3. Tabs 2 and 3 extend from opposite tabs of the printing region 1, respectively. It is then possible to obtain a printed photo image without borders by printing an image slightly larger than the printing region 1, as shown by the area 4*a* of FIG. 1, and then cutting the top tab region 2 and the bottom tab region 3 along the dotted lines 5*a* and 5*b* when printing a photo image on the printing medium 10.

The printing medium 10 may have various sizes, for example, 4"×6", 3"×5", post card size, A6, and the like. Using a printing medium 10 which is smaller than an image to be printed makes it impossible to print the whole image. However, using a printing medium 10 which is larger than an image to be printed makes it impossible to print a borderless image and causes a waste of the printing medium 10.

Generally, one side of the printing medium 10 is used. In a direct thermal printer, the printing medium 10 is inserted in such a way that the color layers for heat-printing a color image face a TPH. Also, in an inkjet printer and a dye sublimation thermal transfer, only one side of the printing medium 10 is used as a printing surface in order to obtain high quality images. In a direct thermal printer, printing conditions such as heating temperature and time for printing, need to be selectively set depending on the sensitivity of the color layers and the kind of printing medium, that is, whether the printing medium is for color printing or mono printing.

Referring to FIGS. 1 and 2, when the length 6*a* of the top tab region 2 and the length 6*b* of the bottom tab region 3 are the same, any one of the top tab region 2 and the bottom tab region 3 of the printing medium 10 may be inserted into the printing unit first. However, when the length 6*a* of the top tab region 2 and the length 6*b* of the bottom tab region 3 are different, the top tab region 2 of the printing medium 10 should be inserted into the printing unit first. For example, if the bottom tab region 3 of the printing medium 10 is inserted into the printing unit first, it is impossible to obtain borderless printing because the image is printed as shown by reference numeral 4*b* of FIG. 2, and a border 7 remains even after the top tab region 2 and the bottom tab region 3 are cut and removed.

Accordingly, a need exists for a system and method for detecting the insertion direction and other desired information regarding a printing medium to minimize printing errors.

SUMMARY OF THE INVENTION

The present invention provides a printing medium for a photo printer that detects the insertion direction of the printing medium. The present invention also provides a printing medium for a photo printer that displays printing medium information including printing conditions. The present invention further provides a printing method for a photo printer using the above printing medium.

According to an aspect of the present invention, a printing medium is provided including a printing region, and a first tab region and a second tab region that extend from opposite tabs of the printing region in a lengthwise direction and which have different lengths from each other. A direction display unit is also provided which is formed in a penetrated manner (such as slits) in any one of the first tab region and the second tab region, and displays an inserting direction of the printing medium.

In an exemplary embodiment of the present invention, the direction display unit is located in any one of the two tab region parts created when the tab regions are divided by a centerline of the printing medium. The embodiment further discloses a pair of dotted lines in order to distinguish the first tab region and the second tab region from the printing region, and to eliminate the tab regions.

According to another aspect of the present invention, a printing medium is provided including a printing region, and a first tab region and a second tab region that extend from opposite tabs of the printing region in a lengthwise direction, respectively. An ID display unit is provided which includes a plurality of slits formed in any one of the first tab region and the second tab region in order to display information regarding the printing medium.

In another exemplary embodiment of the present invention, the ID display unit is located in any one of the two tab region parts created when the tab regions are divided by a centerline of the printing medium. The embodiment further discloses a pair of dotted lines in order to distinguish the first tab region and the second tab region from the printing region, and to eliminate the tab regions.

In the embodiments, the printing medium is a two-side printing medium comprising color layers for heat-printing a color image.

According to another aspect of the present invention, a printing method is provided for a photo printer, the method including steps for providing a printing medium comprising a printing region, and a first tab region and a second tab region that extend from opposite tabs of the printing region, and having a plurality of slits formed in a penetrated manner in any one of the first tab region and the second tab region, wherein the plurality of slits can be located in any one of the two tab region parts created when the tab regions are divided by a centerline of the printing medium. The method further comprises steps for transferring the printing medium and then confirming whether the printing medium is correctly inserted in a lengthwise and/or thickness direction by checking whether the slits are detected within a predetermined time after one tab of the printing medium is detected.

In an embodiment of the present invention, the method further detects information regarding the printing medium such as the size, kind, and sale area of the printing medium by detecting the plurality of slit elements which correspond to medium information based upon the slit lengths, intervals between slits, and the number of the slits.

BRIEF DESCRIPTION OF THE DRAWINGS

The above and other objects, features and advantages of the present invention will become more apparent from the following detailed description taken in conjunction with the accompanying drawings, in which.

Throughout the drawings, like reference numerals will be understood to refer to like parts, components and structures.

DETAILED DESCRIPTION OF THE EXEMPLARY EMBODIMENTS

The present invention will now be described in greater detail with reference to the accompanying drawings, in which, exemplary embodiments of the invention are shown.

A photo printer comprises a printing unit that prints an image, and a transfer roller that transfers a printing medium. The printing unit is an inkjet head in the case of an inkjet printer, and a thermal printing head (TPH) in the case of a dye sublimation thermal transfer printer or a direct thermal transfer photo printer. In the following, a direct thermal printer is described as an example of a printer using a printing medium and a printing method according to exemplary embodiments of the present invention.

Figure 3:
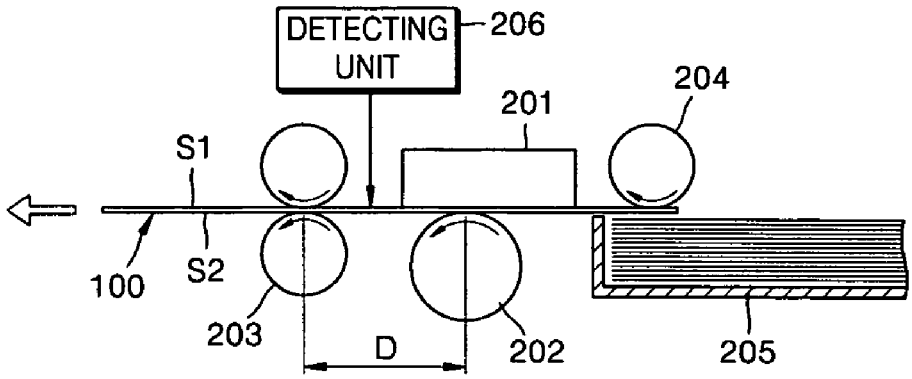
FIG. 3 is a configuration diagram of an example of a photo printer.

FIG. 3 is a configuration diagram of an example of a direct thermal photo printer.

Referring to FIG. 3, a TPH 201 has a plurality of heating elements having micro sizes, and which are arranged in a width direction of a printing medium 100 at predetermined resolution intervals and which are further individually controlled to form an image thereon. A platen roller 202 and the TPH 201 are elastically biased with each other. The platen roller 202 supports the printing medium 100 toward the TPH 201, thereby forming a nip so that the heat produced by the heating elements of the TPH 201 can be sufficiently transmitted to the printing medium 100. A transfer roller 203 then transfers the printing medium 100, drawn from the paper supplier 205 by a pickup roller 204, at a predetermined printing speed. A detecting unit 206 is a photo sensor for detecting the printing medium 100, or a sensor having a micro switch (not shown). The detecting unit 206 detects a direction display unit displaying the insertion direction of the printing medium 100, and further detects an ID display unit displaying the information regarding the printing medium 100. The direction display unit and the ID display unit are described in greater detail below.

Figure 4:
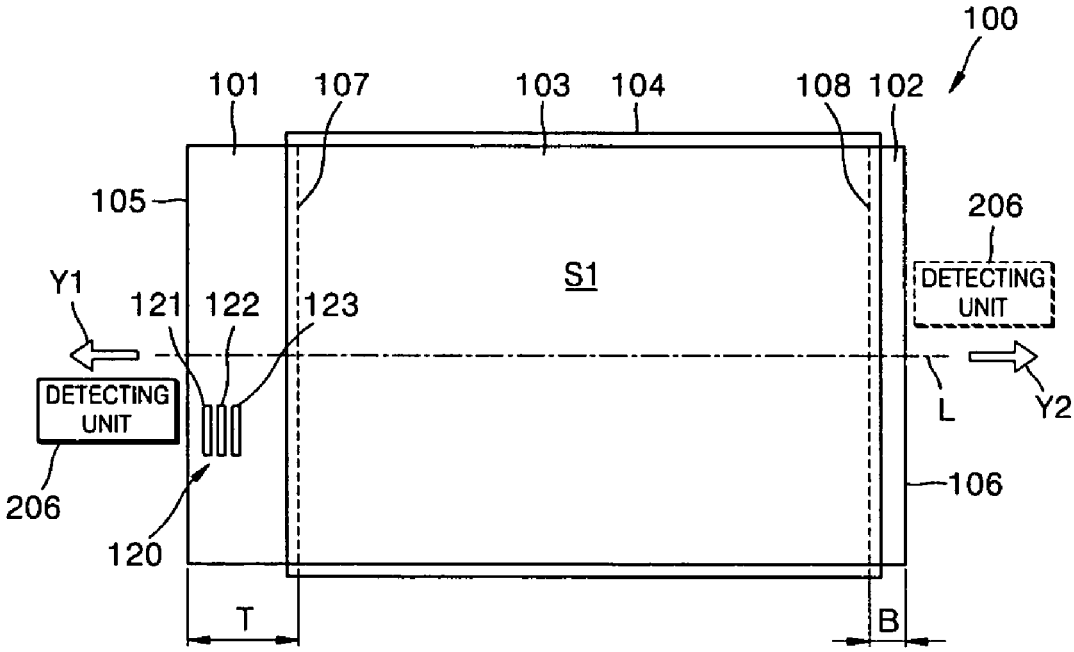
FIG. 4 is a plan view of an embodiment of a printing medium according to the present invention.

FIG. 4 is a plan view of an exemplary embodiment of a printing medium according to the present invention. Referring to FIG. 4, a printing medium 100 comprises a printing region 103, and a first tab region 101 and a second tab region 102 extending from opposite tabs of the printing region 103. The first tab region 101 and the second tab region 102 are demarcated from the printing region 103 by dotted lines 107 and 108, respectively. The dotted lines 107 and 108 are used to eliminate the first tab region 101 and the second tab region 102 after finishing printing.

A slit unit 120 is arranged in the first tab region 101. The slit unit 120 may be located in any one of the two tab region parts created when the tab region 101 is divided by a centerline L of the printing medium 100. A single slit 121 is sufficient for providing a direction display unit. An ID display unit preferably needs more than one slit, for example, three slits 121, 122, and 123, according to the amount of information to be communicated. In the above embodiment, the slit unit 120 works both as a direction display unit, and as an ID display unit. However, the invention should not be construed as being limited to this exemplary embodiment.

Forming a direction display unit and ID display unit in a penetrated manner, like the shapes of the slit unit 120, simplifies the manufacturing processes of the printing medium 100, thus reducing the manufacturing cost. For example, forming a direction display unit and ID display unit in the shape of a printed pattern requires additional processes. That is, the process of manufacturing the printing medium 100 includes cutting the printing medium 100 to have an appropriate size. Accordingly, in this process, the slit unit 120 may be easily formed during an existing process. Therefore, no additional processes are required to form a direction display unit or an ID display unit.

When the top tab 101 of the printing medium 100 drawn from the paper supplier 205 reaches the transfer roller 203, the transfer roller 203 transfers the printing medium 100 at a predetermined speed. A TPH 201 provides heat to the color layers of the printing medium 100 by turning heating elements on and off with respect to input information, thus printing an image 104. The image 104 is printed slightly larger than a printing region 103. A printed image without borders may then be obtained by cutting and removing the first tab region 101 and the second tab region 102 according to the dotted lines 107 and 108 after printing is finished.

The following two aspects should be taken into consideration in deciding the length T of the first tab region 101 and the length B of the second tab region 102. Firstly, the lengths T and B may be as short as possible because the first tab region 101 and the second tab region 102 are eliminated after an image is printed. Secondly, the length T of the first tab region 101 is dependent on the distance between the TPH 201 and the transfer roller 203.

For borderless printing, printing should start in the first tab region 101. For that, at least the TPH 201, more specifically, the heating elements of the TPH 201, should be located in the first tab region 101 when the top tab 105 reaches the transfer roller 203. Therefore, the length T should be larger than the distance D between the TPH 201 and the transfer roller 203. Considering these two aspects, the length T of the first tab region 101 should be determined having regard to the distance D between the TPH 201 and the transfer roller 203, while the length B of the second tab region 102 should be as short as possible, having regard to the convenience of cutting. Because the length T of the first tab region 101 and the length B of the second tab region 102 are different, the top tab 105 in the first tab region 101 of the printing medium 100 should be inserted first. Also, the printing medium 100 should be inserted in such a way that a surface S1 in which the color layers are formed, is facing the TPH 201.

The slit 121 displays information regarding a lengthwise direction and a thickness direction of the printing medium 100. The lengthwise direction indicates whether the printing medium 100 is correctly inserted such that the first tab region 101 enters first. The thickness direction indicates whether the printing medium 100 is correctly inserted with regard to the surface S1 and the back S2, and detecting if the medium 100 is incorrectly turned over. Accordingly, one slit 121 is sufficient to detect the inserting direction of the printing medium 100.

One method of detecting the inserting direction of the printing medium 100 is described in greater detail below.

A printing medium 100 is loaded in the paper supplier 205 and is transferred by a pickup roller 204. The detecting unit 206 detects one tab of the printing medium 100. Depending on the inserting direction of the printing medium 100, the following four cases may be considered. First, if the printing medium 100 is inserted in the direction of Y1 in FIG. 4, one tab of the printing medium 100, the top tab 105, is detected by the detecting unit 206. The slit 121 is then detected after a base time passes, which is calculated by the distance between the top tab 105 and the slit 121, and the transfer speed of the printing medium 100.

Figure 5:
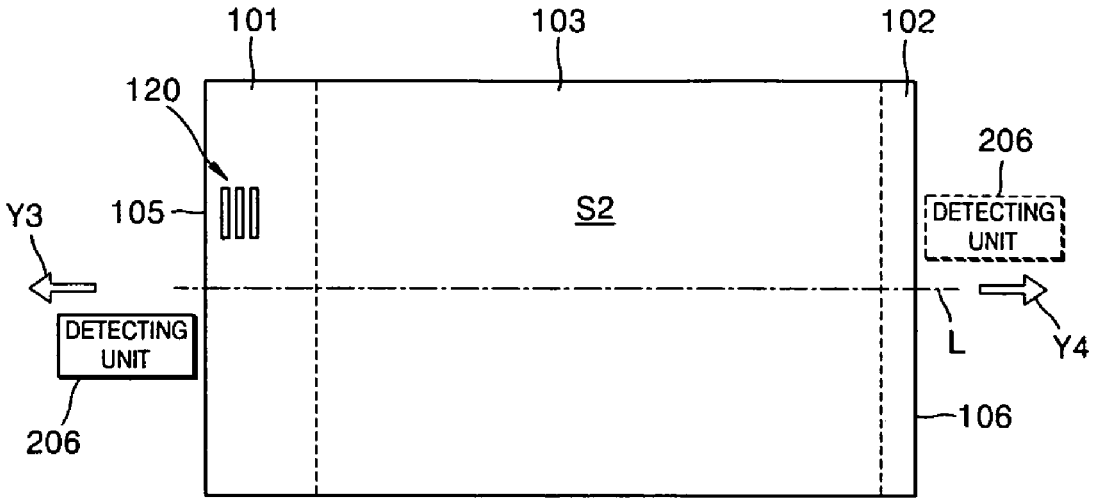
FIG. 5 is a plan view illustrating exemplary operations of a direction display unit according to an embodiment of the present invention.

In a second case, if the printing medium 100 is inserted in the direction of Y2 in FIG. 4, the detecting unit 206 first detects the bottom tab 106 of the printing medium 100 but can not detect the slit 121 because the detecting unit 206 is located in the area marked with the dotted lines in FIG. 4. In a third case, if the printing medium 100 is inserted in the direction of Y3 in FIG. 5, the detecting unit 206 detects the top tab 105 of the printing medium 100 but can not detect the slit 121. In a fourth case, if the printing medium 100 is inserted in the direction of Y4 in FIG. 5, the detecting unit 206 first detects the bottom tab 106 of the printing medium 100 and can detect the slit 121 but after a longer time than the base time because the detecting unit 206 is relatively located in the area marked with the dotted lines in FIG. 4.

In the first case, the lengthwise direction and the thickness direction are correct. In the second case, the lengthwise direction is wrong because the bottom tab 106 of the second region 102 of the printing medium 100 was inserted first. In the third and fourth cases, the inserting direction of the thickness direction is wrong because the back S2 of the printing medium 100 is inserted to face the TPH 201. Therefore, after one tab of the printing medium 100 is detected, the slit 121 may not be detected even after the base time has elapsed. This case corresponds to any one of the second, third and fourth cases, which have a wrong inserting direction. A warning sound and/or an exterior display device may display that the inserting direction of the printing medium 100 was wrong.

Figure 1:
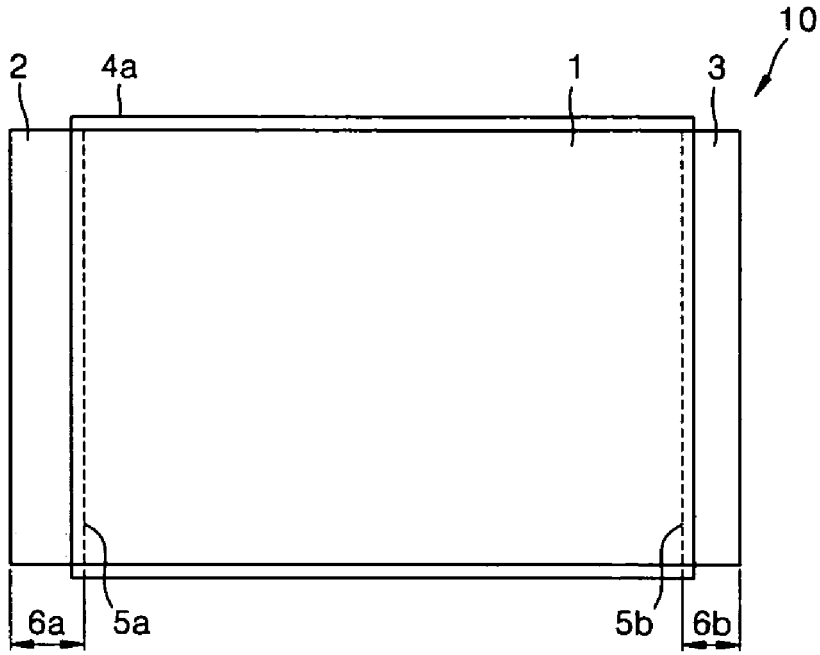
FIG. 1 (PRIOR ART)
FIGS. 1 and 2 are plan views of a conventional printing medium.
Figure 2:
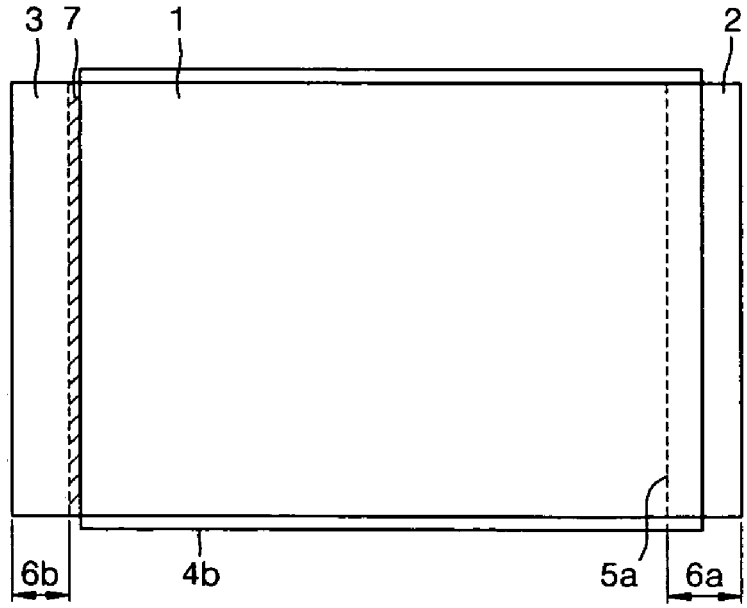
FIG. 2 (PRIOR ART)

The wrong inserting direction of the printing medium 100 may cause an undesired border 7 as shown in FIG. 2 even after the first tab region 101 and the second tab region 102 are cut and removed. The wrong inserting direction of the printing medium 100 may also cause printing errors such as poor printing because the color layers of the printing medium 100 do not face the TPH 201. The printing medium 100 and the printing method according to exemplary embodiments of the present invention substantially prevent the above poor printing by detecting the inserting direction of the printing medium 100, and also improves user convenience because a user can correctly insert the printing medium 100 with respect to the warning of a photo printer.

A method of detecting information regarding the printing medium 100 is now described in greater detail below.

Figure 6:
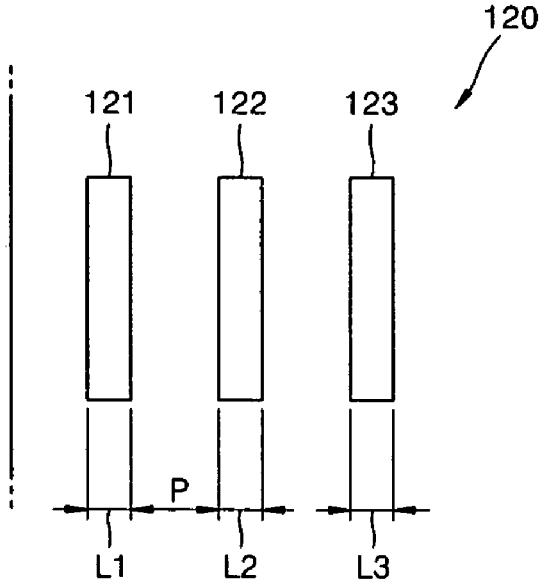
FIG. 6 is a detailed view illustrating exemplary operations of an ID display unit according to an embodiment of the present invention.

FIG. 6 is a detailed view of the slit unit 120 of FIG. 4. The number of slits is related to the amount of information regarding the printing medium 100 that is desired to be displayed. Therefore, the invention should not be construed as being limited by the number of slits shown in the figures. In this exemplary embodiment, an ID display unit comprising three slits 121, 122, and 123 is described as one example.

The detecting unit 206 detects the lengths L1, L2, and L3, intervals P, and the number of slits 121, 122, and 123, as the printing medium 100 is transferred. It is possible to then know the size, kind, and sale area of the printing medium 100 by combining the above information detected by the detecting unit 206. That is, the length L1 of the slit 121 indicates the size of the printing medium 100, whether the slit 122 exists or not indicates whether the printing medium 100 is for color printing or for mono printing, the interval P between the slits 121 and 122 indicates the sensitivity of the color layers of the printing medium 100, and the length L3 of the slit 123 indicates the sale area of the printing medium 100.

The detected size of the printing medium 100 is then compared with the size of the input image information. If the size of the printing medium 100 is not the same as that of the image information, the error in the size of the printing medium 100 may be communicated, or an appropriate size of printing medium 100 may be recommended, each through a warning sound and/or information displayed on an exterior display device.

The warning sound and/or the information displayed on the exterior display device may also inform a user whether the sale area of the printing medium 100 is different from the predetermined sale area. The printing medium 100 is frequently sold at different prices depending on areas (that is, sales in different nations). Therefore, detecting the sale area of the printing medium 100 may prevent the printing medium 100 which was sold in a sale area having a low price, from being used in a sale area having a high price. The information on sale area also indicates whether the printing medium 100 is authentic or not. Therefore, using an unverified printing medium 100 may be prevented.

The information regarding whether the printing medium 100 is for color printing or for mono printing, and the information regarding the kind of printing medium 100 including the sensitivity of the color layers of the printing medium 100, are used in selecting a parameter for driving the TPH 201. Printing conditions, such as the heating temperature and the heating time, preferably need to be controlled with respect to the kind of printing medium 100 in order to obtain a quality image. For this, a photo printer has a built-in look-up table, in which, printing conditions with respect to the kind of printing medium 100 are recorded. After the kind of printing medium 100 is detected, appropriate printing conditions are selected in the look-up table. By driving the TPH 201 with the selected appropriate printing conditions, quality images are obtained.

Figure 7:
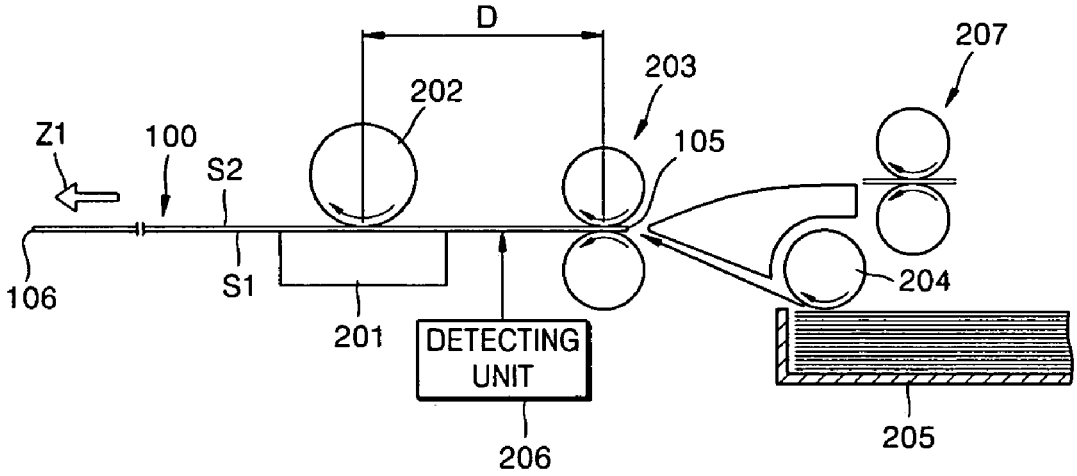
FIGS. 7 and 8 are configuration diagrams of another embodiment of a photo printer according to the present invention.
Figure 8:
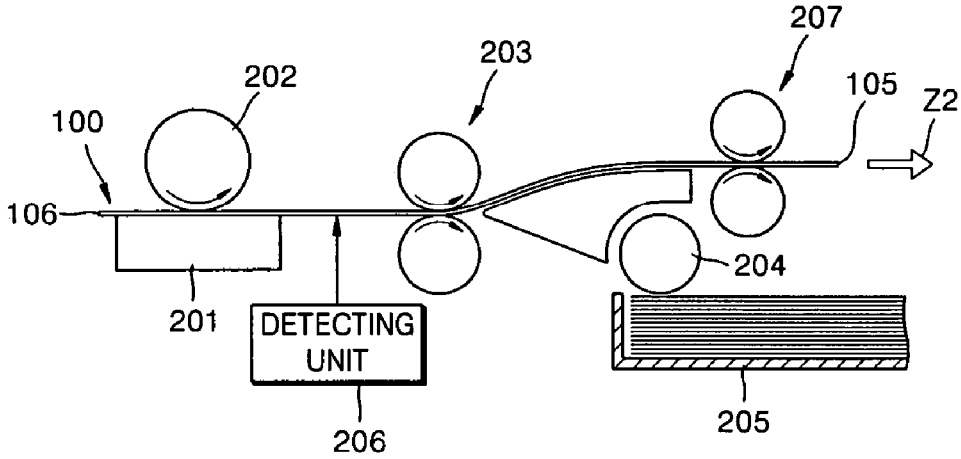

The slit unit 120 used for a direction display unit and an ID display unit is not required to be located in the first tab region 101. The slit unit 120 may be located in the second tab region 102 for convenience, depending on the configuration of the photo printer in some cases. For example, in FIG. 7, a photo printer is shown which draws the printing medium 100 from the paper supplier 205 with the bottom tab 106 drawn first, and transfers the medium 100 in the direction of Z1 until the top tab 105 reaches the transfer roller 203. Then, as shown in FIG. 8, the photo printer prints an image while transferring the printing medium 100 in the direction of Z2. The printing medium 100 is then ejected by an eject roller 207. In this case, locating the slit unit 120, which displays the insertion direction and the information of the printing medium 100, in the second tab region 102 is more convenient because the second tab region 102 passes through the detecting unit 206 first.

Figure 9:
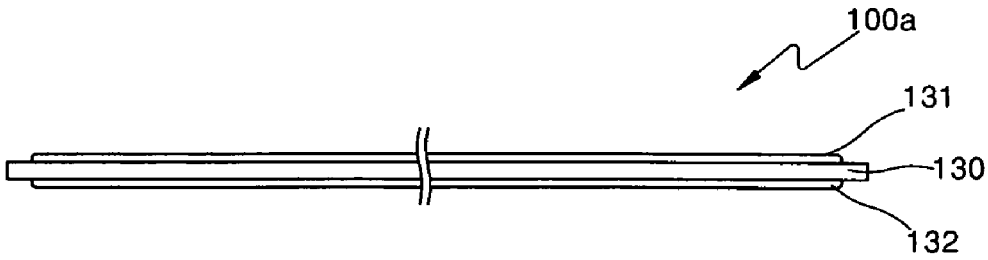
FIG. 9 is a plan view of another embodiment of a printing medium according to the present invention.

A printing medium 100*a* as shown FIG. 9 may be used to form a color image. Referring to FIG. 9, color layers 131 and 132 are formed in the printing medium 100*a* for reacting upon heat and for then delivering predetermined colors in both sides of a base sheet 130. Each color layer 131 and 132 may have a single-layer structure for delivering a single color, or a multi-layer structure for delivering more than 2 colors. For example, the color layer 131 may have a two-layer structure for delivering yellow and magenta, while the color layer 132 may have a single-layer structure for delivering cyan color. The base sheet 130 may be transparent, and/or one of the surfaces of the color layers 131 and 132 may be opaque.

An example of the printing medium 100*a* is disclosed in a U.S. patent publication Ser. No. 2003/0125206 of Bhatt et al., entitled "Thermal Imaging System", the entire contents of which are incorporated herein by reference. However, the embodiments of the present invention should not be construed as being limited to ink accumulation structures on the first side and the second side of the base sheet 130 in a printing medium and a printing method thereof. The printing medium 100*a* is substantially the same as the printing medium 100 in FIG. 4, except that color layers 131 and 132 are located on both sides of the printing medium 100*a*.

Figure 10:
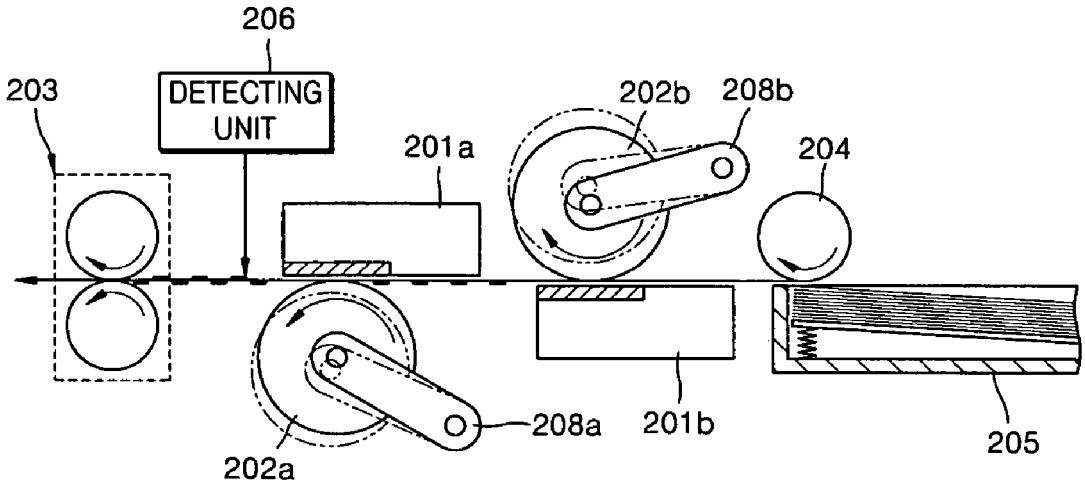
FIG. 10 is a configuration diagram of an example of a direct thermal photo printer using the printing medium shown in FIG. 9 according to an embodiment of the present invention.

FIG. 10 is a configuration diagram of an example of a direct thermal photo printer using the printing medium 100*a* shown in FIG. 9 in accordance with an embodiment of the present invention. FIG. 10 shows a first TPH 201*a* and a second TPH 201*b*, which are separated at a predetermined distance in the transferring direction of the printing medium 100*a*, and are arranged facing the first side and the second side of the printing medium 100*a*, respectively. FIG. 10 further shows a first platen roller 202*a* and a second platen roller 202*b*, which are elastically biased with the first TPH 201*a* and the second TPH 201*b*, respectively, in order to form a nip. Reference numerals 203, 204, 205, and 206 denote a transfer roller, a pickup roller, a paper supplier, and a detecting unit, respectively, which are described with respect to FIG. 3.

In the above example of a direct thermal photo printer, the printing medium 100*a* which is drawn from the paper supplier 205 by the pickup roller 204, is transferred at a predetermined speed by the transfer roller 203 after the top tab of the printing medium 100*a* enters to the transfer roller 203. The first platen roller 202*a* and the second platen roller 202*b* may be installed in a first bracket 208*a* and a second bracket 208*b*, respectively, which are rotatable.

Until the top tab of the printing medium 100*a* enters to the transfer roller 203, the first platen roller 202*a* and the second platen roller 202*b* may be separated from the first TPH 201*a* and the second TPH 201*b*. The first TPH 201*a* heats the first side of the printing medium 100*a* and delivers yellow and magenta colors. For example, heating at a high temperature for a short time delivers yellow color, while heating at a relatively low temperature for a relatively long time delivers magenta color. A yellow and magenta image is then printed on the first side of the printing medium 100*a*. The second TPH 201*b* delivers cyan color by heating the second side of the printing medium 100*a*. In this example, the base sheet 130 is transparent. When printing is completed, a color image with yellow, magenta, and cyan colors can be seen from any of the first side and the second side of the medium 100*a*.

In the above exemplary embodiment, the inserting direction of the printing medium 100*a* can be important. Specifically, if the inserting direction is wrong, heat from the first TPH 201*a* and the second TPH 201*b* is not delivered correctly to the color layers 131 and 132, respectively, thus failing to print a color image. However, such a printing error may be prevented by detecting the slit 121 of the direction display unit by the detecting unit 206.

In the photo printer shown in FIG. 10, correctly identifying the kind of a printing medium can also be important because a color image is printed in a very unique way as described above. Choosing the appropriate inserting direction and identifying the exact kind of printing medium may be achieved by detecting the length, the interval, and the number of the slits 121, 122, and 123 of the ID display unit.

In the above embodiment, the printing medium and a printing method according to the present invention are described by considering a direct thermal photo printer as an example. However, the invention should not be construed as being limited to this printer. A photo printer employing a dye sublimation thermal transfer method or an inkjet method may also apply the above printing media and printing method.

Also, although information on a printing medium was described by presenting a printing medium used in a direct thermal photo printer as an example, the desired information on a printing medium, such as the number, the length, and the interval of a slit, may be displayed according to other printing methods, such as a dye sublimation thermal transfer method and an inkjet method.

The printing medium and the printing method according to the present invention may reduce manufacturing costs because a slit can be formed during the existing process of cutting the printing medium according to its size, thereby forming a direction display unit and an ID display unit in a shape of a penetrated slit.

The printing medium and the printing method may also prevent a printing error caused by inserting the printing medium in a wrong direction by detecting whether the printing medium is inserted in a correct direction.

The printing medium and the printing method may also reduce poor printing and the resulting losses. The detection of the size of a printing medium may prevent poor printing caused by printing an image on a printing medium having a different size from the size of image information.

The printing medium and the printing method also make it possible to adopt different price policies according to sale areas.

The invention may, however, be embodied in many different forms within the scope of the following claims and should not be construed as being limited to the embodiments set forth herein.

What is claimed is:

1. A printing medium for a photo printer, comprising:

a printing region;

a first tab region and a second tab region extending from opposite sides of the printing region, respectively, and having different lengths from each other; and a direction display unit formed in a penetrated manner in any one of the first tab region and the second tab region, wherein the direction display unit comprises a plurality of slit elements for expressing information about the printing medium, and wherein the slit elements comprise a slit length, an interval between slits, and a number of slits.

2. The printing medium of claim 1, wherein the direction display unit is located in any one of two parts of the first tab region and the second tab region when each region is divided into the two parts by a centerline of the printing medium.

3. The printing medium of claim 1, further comprising a pair of dotted lines in order to distinguish the first tab region and the second tab region from the printing region and to eliminate the tab regions.

4. The printing medium of claim 1, wherein the printing medium is a two-side printing medium comprising a plurality of color layers for heat-printing a color image by reacting to heat on both sides.

5. A printing medium for a photo printer, comprising:

a printing region;

a first tab region and a second tab region extending from opposite sides of the printing region; and an ID display unit comprising a plurality of slits formed in any one of the first tab region and the second tab region to display information about the printing medium, wherein the information about the printing medium is expressed by a plurality of slit elements, and wherein the slit elements comprise a slit length, an interval between slits, and a number of slits.

6. The printing medium of claim 5, wherein the information about the printing medium comprises information regarding a size, a kind, and a sale area of the printing medium.

7. The printing medium of claim 5, wherein the first tab region and the second tab region have different lengths.

8. The printing medium of claim 5, wherein the ID display unit is located in any one of two parts of the first tab region and the second tab region when each region is divided into the two parts by a centerline of the printing medium.

9. The printing medium of claim 5, further comprising a pair of dotted lines in order to distinguish the first tab region and the second tab region from the printing region and to eliminate the tab regions.

10. The printing medium of claim 5, wherein the printing medium is a two-side printing medium comprising a plurality of color layers for heat-printing a color image by reacting to heat on both sides.

11. A printing method for a photo printer, the method comprising the steps of:

providing a printing medium comprising a printing region, and a first tab region and a second tab region extending from opposite sides of the printing region;

providing a plurality of slits in a penetrated manner in any one of the first tab region and the second tab region, wherein the plurality of slits are located in any one of two parts of the first tab region and the second tab region when each region is divided into the two parts by a centerline of the printing medium;

transferring the printing medium for printing;

confirming whether the printing medium is correctly inserted by checking whether the plurality of slits are detected within a predetermined time after one tab of the printing medium is detected; and detecting information about the printing medium by detecting a plurality of slit elements, wherein the slit elements comprise a slit length, an interval between slits, and number of slits.

12. The method of claim 11, wherein:

the detected information about the printing medium includes size, kind, and sale area of the printing medium.

13. The method of claim 12, further comprising the step of:

preventing printing when a detected sale area of the printing medium does not correspond to a predetermined sale area.

14. The method of claim 12, further comprising the step of:

preventing printing when a detected size of the printing medium is different from a size of an input image information.

15. The method of claim 12, further comprising the steps of:

selecting printing conditions from a preset look-up table with respect to the kind of the printing medium; and controlling the printing based upon the selected printing conditions.

* * * * *